US010087645B2

(12) United States Patent
Herring

(10) Patent No.: US 10,087,645 B2
(45) Date of Patent: Oct. 2, 2018

(54) ROBOTIC SWIMMING POOL CLEANER

(71) Applicant: SpectraLight Technologies, Inc., Georgetown, TX (US)

(72) Inventor: Jason Herring, Georgetown, TX (US)

(73) Assignee: SpectraLight Technologies, Inc., Georgetown, TX (US)

( * ) Notice: Subject to any disclaimer, the term of this patent is extended or adjusted under 35 U.S.C. 154(b) by 821 days.

(21) Appl. No.: 14/109,681

(22) Filed: Dec. 17, 2013

(65) Prior Publication Data

US 2014/0166045 A1 Jun. 19, 2014

Related U.S. Application Data

(60) Provisional application No. 61/738,016, filed on Dec. 17, 2012.

(51) Int. Cl.
*E04H 4/16* (2006.01)

(52) U.S. Cl.
CPC ..... *E04H 4/1654* (2013.01)

(58) Field of Classification Search
CPC ..... E04H 4/1654; E04H 4/16
USPC ..... 15/1.7
See application file for complete search history.

(56) References Cited

U.S. PATENT DOCUMENTS 5,133,503 A * 7/1992 Giordano ..... B05B 15/061 134/167 R
5,853,676 A 12/1998 Morgan, Jr.
8,112,841 B2 2/2012 Garcia et al.
2004/0025268 A1* 2/2004 Porat ..... E04H 4/1654 15/1.7
2004/0244138 A1 12/2004 Taylor et al.
2008/0128343 A1 6/2008 Garti
2010/0306931 A1 12/2010 Garti
2011/0214686 A1* 9/2011 Chavana, Jr. ..... A47L 9/00 134/1
2012/0189491 A2 7/2012 Porat
2014/0263087 A1* 9/2014 Renaud ..... E04H 4/1654 210/745

FOREIGN PATENT DOCUMENTS

WO WO-2007136831 A2 11/2007

OTHER PUBLICATIONS

"European Application Serial No. 13197455.2, Extended European Search Report dated Nov. 13, 2015", 8 pgs.

* cited by examiner

*Primary Examiner* — David Redding
(74) *Attorney, Agent, or Firm* — Schwegman Lundberg & Woessner, P.A.

(57) ABSTRACT

A pool cleaning robot can include a main housing configured to be submerged in a pool. A propulsion unit within the main housing can be configured to move the pool cleaning robot along a pool surface. One or more germicidal light sources, configured to disinfect at least a portion of a pool surface, can be positioned on a bottom of the main housing. A power unit can be configured to power the propulsion unit and the one or more germicidal light sources of the pool cleaning robot.

14 Claims, 10 Drawing Sheets

ROBOTIC SWIMMING POOL CLEANER

CLAIM OF PRIORITY

This application claims the benefit of priority under 35 U.S.C. § 119(e) of Herring, U.S. Provisional Application Ser. No. 61/738,016, entitled "ROBOTIC SWIMMING POOL CLEANER", filed Dec. 17, 2012, which is herein incorporated by reference in its entirety.

BACKGROUND

Swimming pool cleaners, such as an automated robotic cleaner, can scan a floor or a sidewall of a swimming pool. Examples of such units can include onboard battery power or can utilize a power cord to access external power. Robotic swimming pool cleaners can scrub a floor or sidewall of the swimming pool to dislodge debris adhered to the pool surface. The dislodged debris can then be run through an onboard filter or pumped through an external filter that is separate from the automated robotic cleaner. Further, some pool cleaners can pump pool water through a light field to disinfect the water.

SUMMARY

The present inventor has recognized, among other things, that a germicidal light source can be implemented for swimming pool cleaning For example, an automated robotic swimming pool cleaner can include at least one germicidal light source configured to be oriented toward a swimming pool surface and operable to disinfect the swimming pool surface. To better illustrate the robotic swimming pool cleaner and related methods disclosed herein, a non-limiting list of examples is provided below.

In Example 1, a pool cleaning robot comprises a main housing configured to be submerged in a pool, a propulsion unit within the main housing configured to move the pool cleaning robot along a pool surface, and one or more germicidal light sources positioned on a bottom of the main housing and configured to disinfect at least a portion of a pool surface. A power unit configured to power at least the propulsion unit and the one or more germicidal light sources.

In Example 2, the pool cleaning robot of Example 1 is optionally configured such that the one or more germicidal light sources comprise a UV-C light emitting source and an elongated tube attached to the main housing and configured to contain the UV-C light emitting source in an air tight environment.

In Example 3, the pool cleaning robot of any one of or any combination of Examples 1 or 2 is optionally configured such that the elongated tube includes fused quartz.

In Example 4, the pool cleaning robot of any one of or any combination of Examples 1-3 is optionally configured such that the UV-C light emitting source is a low pressure lamp.

In Example 5, the pool cleaning robot of any one of or any combination of Examples 1-4 is optionally configured such that the UV-C light emitting source is a medium pressure lamp.

In Example 6, the pool cleaning robot of any one of or any combination of Examples 1-5 is optionally configured such that the elongated tube is configured to absorb a mercury emission line.

In Example 7, the pool cleaning robot of any one of or any combination of Examples 1-6 is optionally configured such that the one or more germicidal light sources are configured to be positioned at least about 0.1 inches from a pool surface.

In Example 8, the pool cleaning robot of any one of or any combination of Examples 1-7 is optionally configured such that the one or more germicidal light sources are configured to be positioned less than about 1.5 inches from a pool surface.

In Example 9, the pool cleaning robot of any one of or any combination of Examples 1-8 is optionally configured such that the one or more germicidal light sources are configured to emit light from about 90 nanometers to about 300 nanometers in wavelength.

In Example 10, the pool cleaning robot of any one of or any combination of Examples 1-9 is optionally configured such that the propulsion unit includes one or more wheels configured to propel the pool cleaning robot along a pool surface.

In Example 11, the pool cleaning robot of any one of or any combination of Examples 1-9 is optionally configured such that the propulsion unit includes at least one track extending substantially along a length of the main housing and configured to propel the pool cleaning robot along a pool surface.

In Example 12, the pool cleaning robot of any one of or any combination of Examples 1-11 is optionally configured such that the propulsion unit includes a propulsion motor configured to drive movement of the pool cleaning robot.

In Example 13, the pool cleaning robot of any one of or any combination of Examples 1-12 is optionally configured to further comprise one or more brushes rotatable about an axis of rotation and configured to contact a pool surface.

In Example 14, the pool cleaning robot of any one of or any combination of Examples 1-13 is optionally configured to further comprise a pump unit, including one or more inlets in the bottom of the main housing, configured to intake at least water and an impeller configured to pump water through the inlet.

In Example 15, the pool cleaning robot any one of or any combination of Examples 1-14 is optionally configured such that the pump unit is configured to provide enough suction force to maintain the pool cleaning robot in contact with a pool surface.

In Example 16, the pool cleaning robot of any one of or any combination of Examples 1-15 is optionally configured such that the one or more brushes are rotatable in a direction toward the inlet.

In Example 17, the pool cleaning robot of any one of or any combination of Examples 1-16 is optionally configured such that the power unit further comprises a power cord configured to connect to a power outlet, the power cord extending from the main housing.

In Example 18, the pool cleaning robot of any one of or any combination of Examples 1-17 is optionally configured such that the power cord includes a 360 degree swivel configured to reduce tangles in the power cord.

In Example 19, the pool cleaning robot of any one of or any combination of Examples 1-18 is optionally configured such that the power unit includes one or more batteries on or within the main housing.

In Example 20, the pool cleaning robot of any one of or any combination of Examples 1-19 is optionally configured to further comprise a switch to automatically shut off the one or more germicidal light sources.

In Example 21, the pool cleaning robot of any one of or any combination of Examples 1-20 is optionally configured such that the switch includes a contact switch configured to shut the one or more germicidal light sources off when the contact switch is not depressed.

In Example 22, the pool cleaning robot of any one of or any combination of Examples 1-21 is optionally configured such that the switch includes a gyroscopic switch configured to shut the one or more germicidal light sources off when the pool cleaning robot is oriented beyond a threshold angle.

In Example 23, a method for cleaning a pool surface comprises submerging a pool cleaning robot in a pool including a pool surface, passing the pool cleaning robot along the pool surface, and exposing at least a portion of the pool surface to one or more germicidal light sources positioned on a bottom of the pool cleaning robot.

In Example 24, the method of Example 23 is optionally configured such that exposing at least a portion of the pool surface further comprises powering one or more UV-C light emitting sources contained within a fused quartz tube sealed to the bottom of the pool cleaning robot, permitting the germicidal light emitted by the one or more UV-C light emitting sources to pass through the fused quartz tube to expose at least the portion of the pool surface to the germicidal light, and passing the one or more UV-C light emitting sources in close proximity to the pool surface.

In Example 25, the method any one of or any combination of Examples 23 or 24 is optionally configured to further comprise brushing the pool surface with one or more rotatable brushes rotatably attached to the pool cleaning robot, pumping water from the pool through one or more inlets in the pool cleaning robot, passing the pumped water through a filter, and providing the filtered water to the pool.

In Example 26, the method of any one of or any combination of Examples 23-25 is optionally configured such that passing the pool cleaning robot along the pool surface further comprises powering one or more wheels to propel the pool cleaning robot along the pool surface.

In Example 27, the method of any one of or any combination of Examples 23-26 is optionally configured such that passing the pool cleaning robot along the pool surface further comprises powering at least one track in contact with the pool surface to propel the pool cleaning robot along the pool surface.

In Example 28, the method of any one of or any combination of Examples 24-27 is optionally configured to further comprise automatically switching the one or more UV-C light emitting sources off when a gyroscopic switch detects the pool cleaning robot is oriented beyond a threshold angle.

In Example 29, the method of any one of or any combination of Examples 24-28 is optionally configured to further comprise automatically switching the one or more UV-C light emitting sources off when a contact switch is not depressed.

In Example 30, the method of any one of or any combination of Examples 25-29, is optionally configured to further comprise maintaining contact with the pool surface by drawing water through the one or more inlets of the pool cleaning robot to provide a sufficient suction force.

In Example 31, the method of any one of or any combination of Examples 24-30 is optionally configured to further comprise maintaining the one or more UV-C light emitting sources within a distance of about 0.1 inches to about 1.5 inches from the pool surface.

In Example 32, a pool cleaning robot comprises a main housing configured to be submerged in a pool, a propulsion unit within the main housing configured to move the pool cleaning robot along a pool surface, and an elongated fused quartz tube attached to a bottom of the main housing. A UV-C light emitting source can be configured to emit a germicidal light to disinfect at least a portion of a pool surface, housed in an air tight environment within the elongated fused quartz tube. Further, a pump unit can include an inlet in the bottom of the main housing, configured to intake water and a pump motor configured to pump water from the pool through the inlet. A power unit can be configured to power the propulsion unit, the UV-C light emitting source, and the pump unit.

In Example 33, the pool cleaning robot of Example 32 is optionally configured to further comprise one or more reflectors on the bottom of the main housing configured to reflect the germicidal light toward a pool surface.

In Example 34, the robotic swimming pool cleaner or method of any one or any combination of Examples 1-33 is optionally configured such that all elements or options recited are available to use or select from.

These and other examples and features of the present robotic swimming pool cleaners and methods will be set forth in part in the following Detailed Description. This Summary is intended to provide non-limiting examples of the present subject matter—it is not intended to provide an exclusive or exhaustive explanation. The Detailed Description below is included to provide further information about the present robotic swimming pool cleaners and methods.

BRIEF DESCRIPTION OF THE DRAWINGS

In the drawings, which are not necessarily drawn to scale, like numerals may describe similar components in different views. The drawings illustrate generally, by way of example, but not by way of limitation, various embodiments discussed in the present document.

DETAILED DESCRIPTION

The present disclosure relates generally to a robotic swimming pool cleaner and related method. Generally, a pool cleaning robot can include a main housing configured to be submerged in a pool. The main housing can include a propulsion unit configured to move the pool cleaning robot along a surface of the pool, a germicidal light source, configured to disinfect at least a portion of the surface of the pool, positioned on the bottom of the robot, and a power unit configured to power at least the propulsion unit and the germicidal light source of the pool cleaning robot.

Figure 1:
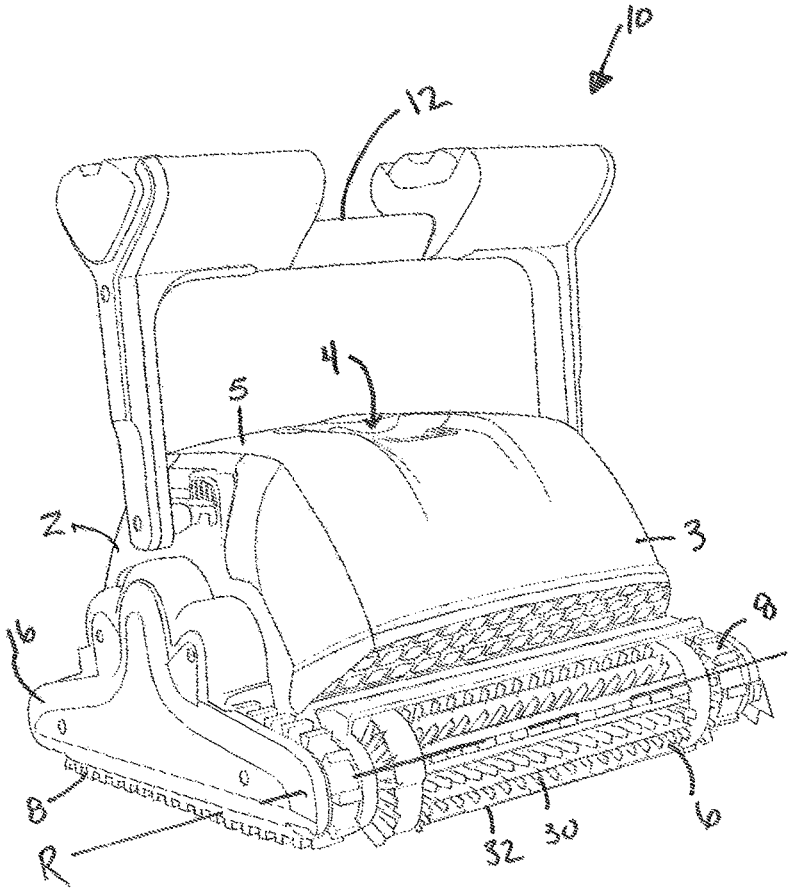
FIGS. 1-3 illustrate perspective views of a robotic swimming pool cleaner in accordance with at least one example of the present disclosure.
Figure 2:
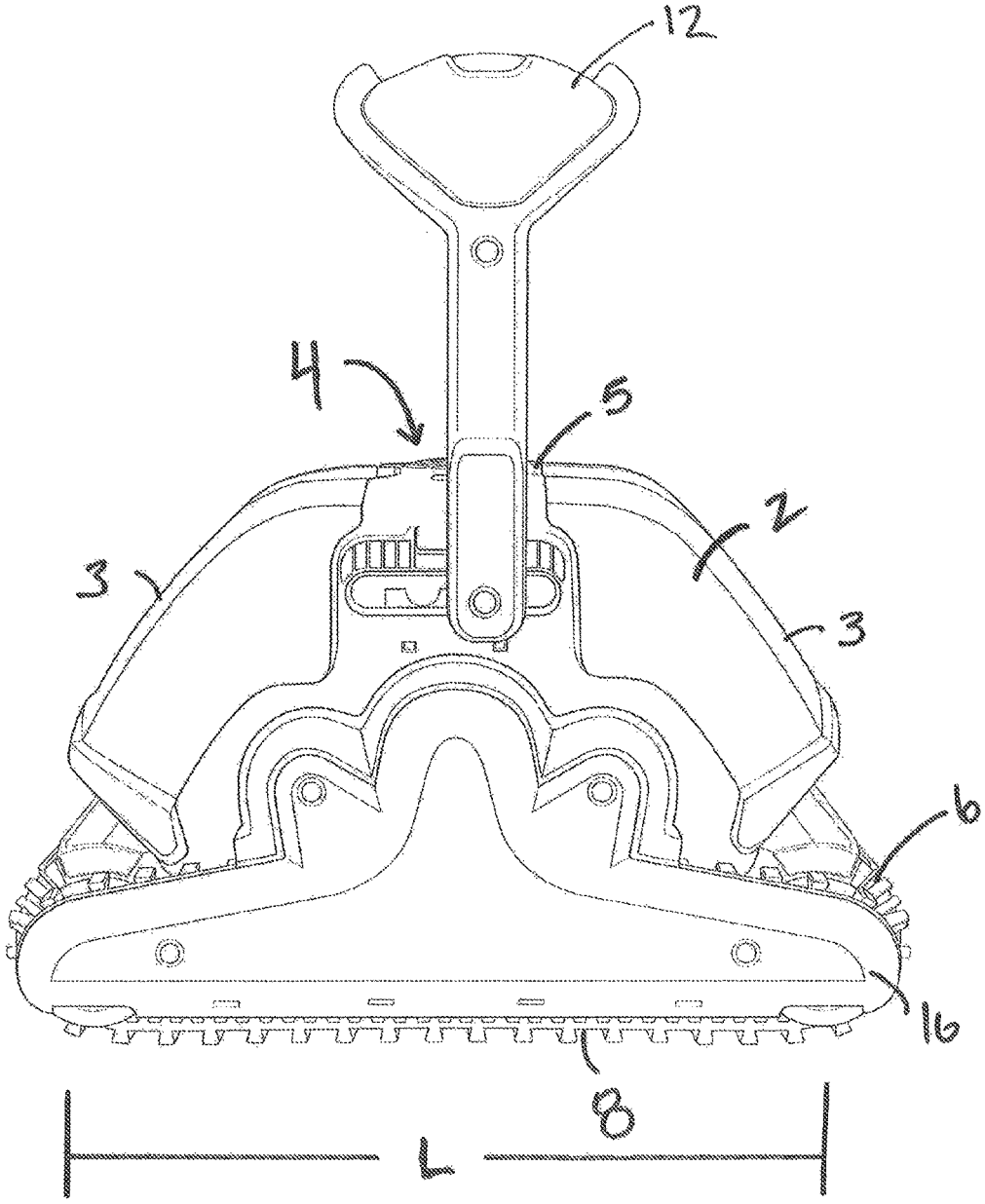

As shown in FIGS. 1 and 2, a pool cleaning robot 10 can include a main housing 2, one or more brushes 6 rotatable about an axis R, and a track 8 configured to contact the pool surface to propel the pool cleaning robot 10 along the pool surface. The main housing 2 can include a removable cover 3, an outlet 4 oriented toward a top side 5 of the main housing 2, and a handle 12 attached thereto. In an example, the main housing 2 can include at least one side panel 16 configured to cover at least a portion of a propulsion unit 70, as discussed in connection with FIG. 8. The propulsion unit can be configured to move the pool cleaning robot 10 along the swimming pool surface, such as forwards, backwards, side to side, or up and down a pool wall. For example, the pool cleaning robot 10 can include at least one track 8 or wheel 72, as discussed in connection with FIG. 8, configured to contact the pool surface to propel the pool cleaning robot.

The track 8 can extend along at least a portion of a length L of the main housing 2. As shown in FIG. 2, the track 8 can extend beyond the length L of the main housing 2, but examples are not so limited. For example, the pool cleaning robot 10 can include a track 8 that extends about 10% of the length L, about 20% of the length L, about 30% of the length L, about 40% of the length L, about 50% of the length L, about 60% of the length L, about 70% of the length L, about 80% of the length L, about 90% of the length L, about 100% of the length L, about 110% of the length L, about 120% of the length L, or about 130% of the length L. The track 8 can, in an example, use the wheel (not shown) to drive the track. The propulsion unit can include at least one of a propulsion motor, a gear, a wheel, a transmission unit, or a drive unit, along with corresponding parts necessary for the propulsion unit components to operate. An exemplary propulsion unit is described in US Patent Pub. No. 2010/0306931, which is incorporated herein by reference in its entirety.

In an example, the pool cleaning robot 10 can be controlled wirelessly, such as by a computer or phone (e.g., smartphone). For example, a smartphone, such as by a mobile application, can be configured to control a direction or path of the pool cleaning robot 10. Further, the direction or path of the pool cleaning robot 10 can be pre-programmed or controlled in real-time. In an example, a sensor module, as discussed herein in connection with FIGS. 4-5B, can be controlled, adjusted, or programmed by a computer or phone. For example, pool chemistry specifications (e.g., salinity, pH level, water hardness, etc.) can be pre-programmed or controlled in real-time. The computer or smartphone can customize the path of the pool cleaning robot 10, such as adjusting a percentage of time the pool cleaning robot 10 spends on a tile line, wall, bottom, or segment of the pool. That is, in general, the pool cleaning robot 10 can be adjusted wirelessly so as to adjust duration, path, and pool chemistry.

As shown in FIG. 1, each of the one or more brushes 6 can include a plurality of bristles 30 configured for dislodging debris from the surface of the pool while the brush 6 is rotating about the axis R. The plurality of bristles 30 can be substantially identical or can vary in shape and/or size. Each of the bristles 30 can be configured for a designated purpose, such as dislodging debris or moving the dislodged debris in a desired direction. Further, each of the one or more brushes 6 can include a plurality of semi-rigid or rigid bars 32 configured to push or pull debris in a desired direction. In an example, the one or more brushes 6 can rotate independent of a direction the pool cleaning robot 10 is moving. An exemplary bristle design is described in US Patent Pub. No. 2012/0306931, which is in incorporated herein by reference in its entirety.

Figure 3:
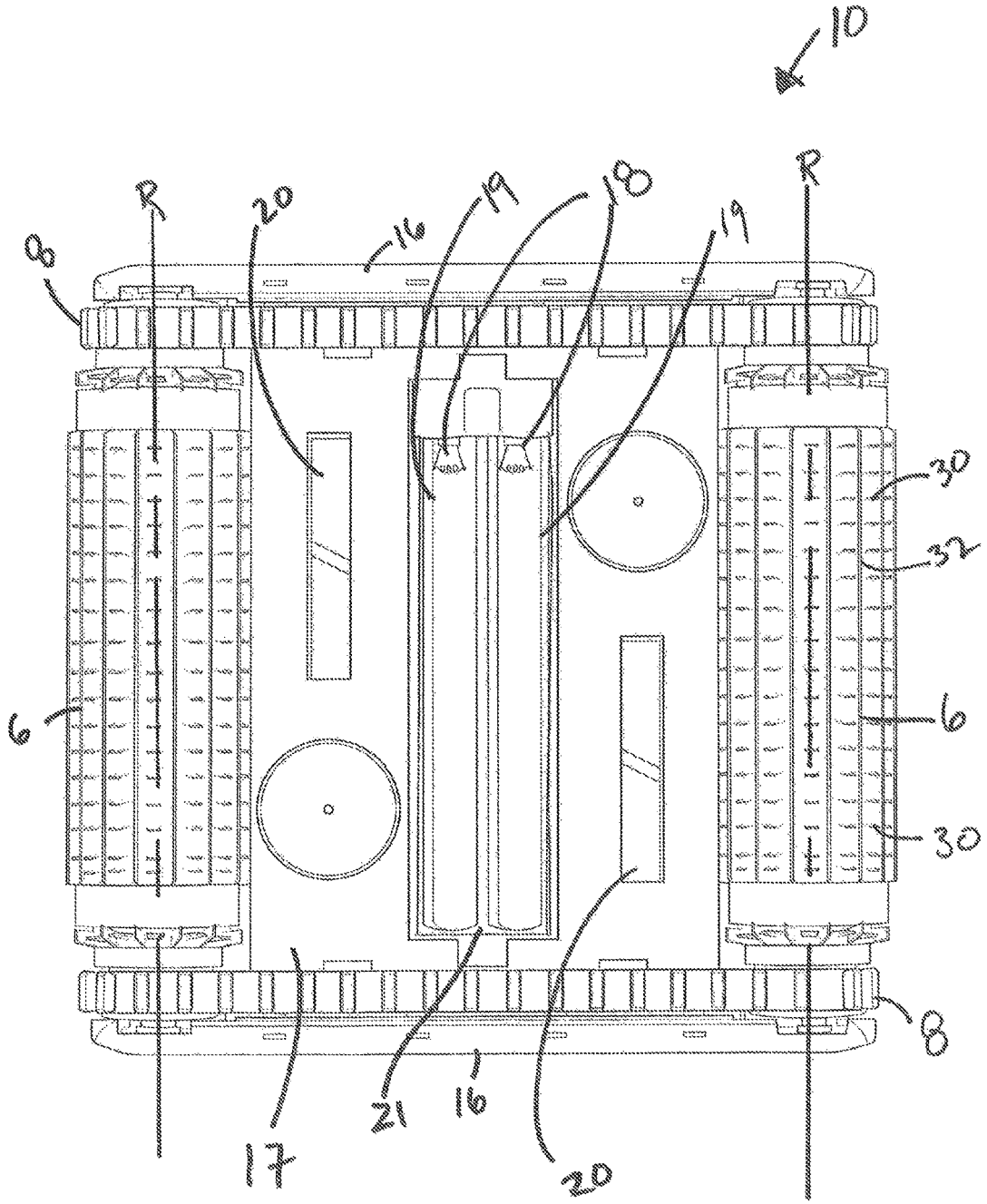

FIG. 3 illustrates a bottom view of the pool cleaning robot 10, in accordance with an example of the present disclosure. A bottom side 17 of the main housing 2 can include one or more germicidal light sources 18 and one or more inlets 20. The one or more inlets 20 can be positioned at any location on the bottom 17 of the main housing 2, so long as they do not interfere with the one or more brushes 6 or the one or more germicidal light sources 18. In an example, the one or more brushes 6 can rotate about the axis R so that at least a portion of the dislodged debris from the pool surface is pushed or pulled toward the one or more inlets 20.

Figure 4:
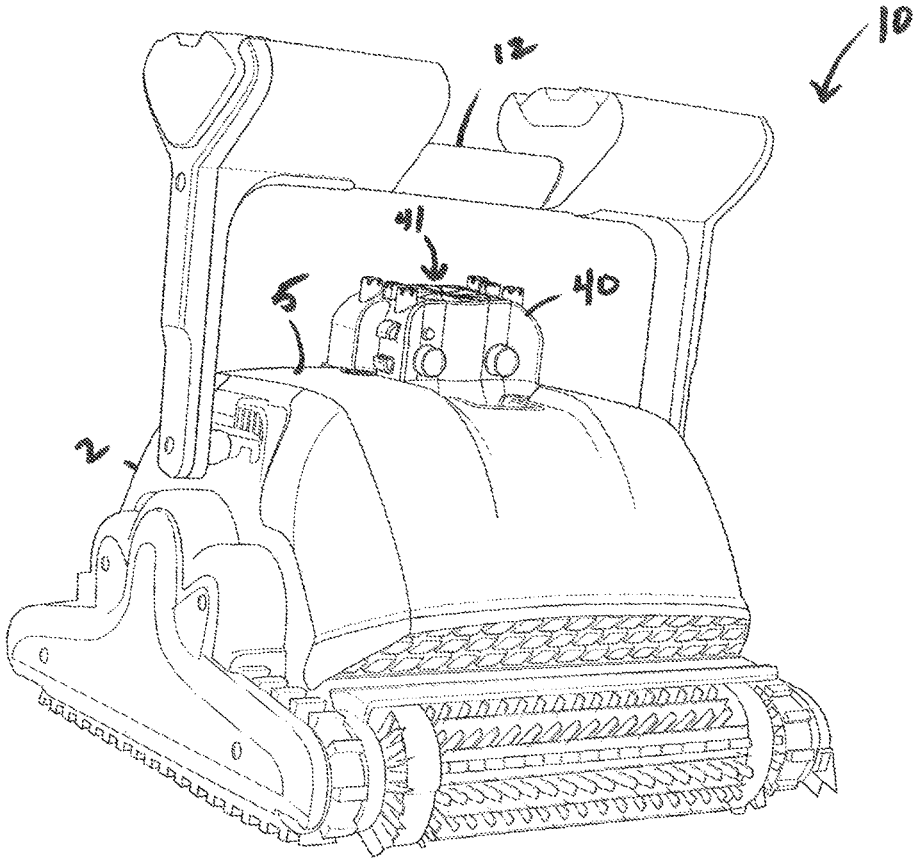
FIG. 4 illustrates a side view of a robotic swimming pool cleaner with a sensor module in accordance with at least one example of the present disclosure.

FIG. 4 illustrates a pool cleaning robot, such as the pool cleaning robot 10, including a sensor module 40. The sensor module 40 can be configured to be removably coupled to the pool cleaning robot 10, such as on the top side 5 of the main housing 2, but not interfere with movement of the handle 12. For example, the handle 12 can be pivotably or fixably coupled to the main housing 2. The sensor module 40 can be an add-on feature of the pool cleaning robot or system. The sensor module 40 can be configured to adjust or maintain pool chemistry, such as an aqueous chemistry of the pool water.

In an example, the sensor module 40 can be coupled to the pool cleaning robot by at least one screw threadably with at least one corresponding threaded orifice of the pool cleaning robot 10. In an example, the sensor module 40 can be coupled to the pool cleaning robot 10 by at least one of a locking device, a clamping device, a pin, or some other fastening device. The sensor module 40 can be fixably coupled to the pool cleaning robot 10. In an example, the sensor module 40 can be configured to couple about or over the outlet 4, so as to not prevent fluid communication through the outlet 4. For example, the sensor module 40 can include a fluid passage 41 to permit fluid to flow from the outlet 4 through the sensor 40 and out beyond the pool cleaning robot 10, such as to the pool.

In an example, the sensor module 40 can be configured to manually or automatically detect, analyze, or adjust the pool chemistry, including, but not limited to, pH, oxidation-reduction potential (ORP), free chlorine, total chlorine, salt level, hydrogen peroxide, temperature, Langelie saturation index, alkalinity, calcium hardness, cyanuric acid level (e.g., stabilizer), or transparency value. The sensor module 40 can be configured to relay monitored pool chemistry values to corresponding equipment wirelessly or by a cable. As discussed herein, the sensor module 40 can communicate pool chemistry values with a computer, server, or phone. The pool chemistry values can be stored, so as to provide historical pool chemistry data, including a graphical or chart historical pool chemistry representation. Further, the computer, server, or phone can be configured to share the pool chemistry values with a technician, so as to trouble shoot or provide recommendations on pool treatment. For example, the corresponding equipment can be configured to release chemicals, such as liquid or gaseous, including $CO_2$, into the pool to control one of more of the pool chemistry parameters. Corresponding equipment can include pool maintenance equipment commonly used in the field, including, but not limited to, pool pumps, pool heaters, solar heating systems, or the like. In an example, pool chemistry ranges can be pre-programed by a user or adjusted in real-time, such as in response to the monitored pool chemistry values or in the course of regular pool maintenance.

Figure 5A:
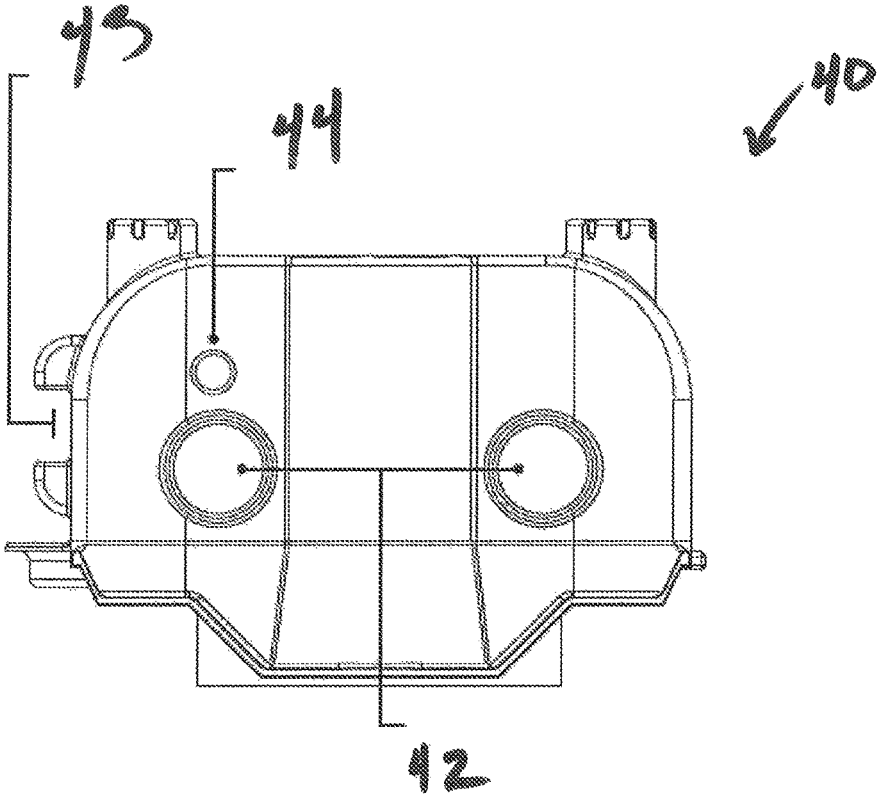
FIG. 5A illustrates a side view of the sensor module of FIG. 4 in accordance with at least one example of the present disclosure.

FIG. 5A shows a side view of the sensor module 40. In an example, the sensor module can include an ultrasonic transducer 42, configured to emit ultrasonic sound waves so as to inhibit algae growth in a swimming pool. For example, the ultrasonic sound waves can be in a wavelength range configured to closely match the harmonic frequency of gas vesicles inside algae cell walls, such as to destroy them. Further, the ultrasonic transducer 42 can be configured to emit sound waves within a wavelength range within a harmonic frequency configured to interfere with the chemical bond between cytoplasm and cell walls, so as to prevent the algae from consuming nutrients or disposing of waste. In an example, the sensor module 40 can include a water clarity sensor 43, such as turbidity, as is commonly understood in the field. In an example, the water clarity sensor 43 can be configured to detect the presence of dirt, particles, or debris in the pool, such that a path or duration of cleaning time of the pool cleaning robot 10 can be determined or followed. For example, a water clarity reading below a threshold value can communicate to the pool cleaning robot 10 to keep moving, as the water in its present location meets clarity specifications. Further, the sensor module 40 can include a temperature sensor 44, configured to monitor or control the temperature of the pool water. For example, the temperature sensor 44 communicatively coupled, such as hard wired or wirelessly, to a pool heating system.

Figure 5B:
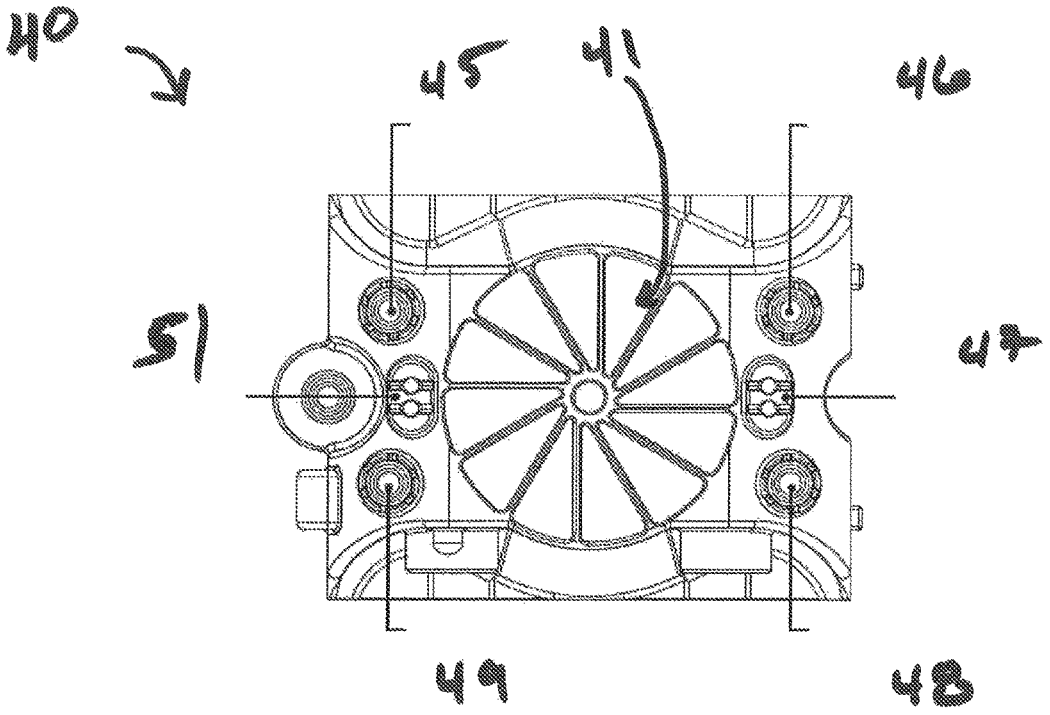
FIG. 5B illustrates a top view of the sensor module of FIG. 4 in accordance with at least one example of the present disclosure.

FIG. 5B shows a top view of the sensor module 40. As discussed herein, the fluid passage 41 can be configured or positioned on the pool cleaning robot 10 so as to permit water to pass from the outlet to the pool. In an example, a pH sensor 45 can be configured to monitor or control a pH level or alkalinity level of the pool water. A cyanuric acid sensor 46 can be configured to monitor the cayanuric acid levels in a pool, so as to provide a recommendation. In an example, a salinity or total dissolved solids (TDS) sensor 47 can be configured to monitor or control the salinity or dissolved solids in a pool. Total dissolved solids can include the total amount of mobile charged ions, including minerals, salts, or metals dissolved in a given volume of water.

Further, the sensor module 40 can include chlorine sensor, configure to monitor or control free chlorine levels or total chlorine levels, as commonly understood in the industry. An oxidation-reduction potential (ORP) sensor 49 configured to monitor or control ORP, as commonly understood in the industry. A water hardness sensor 51 can be configured to monitor or control various water hardness measurements, including, but not limited to Langelier saturation index, calcium hardness, or the like.

Figure 6:
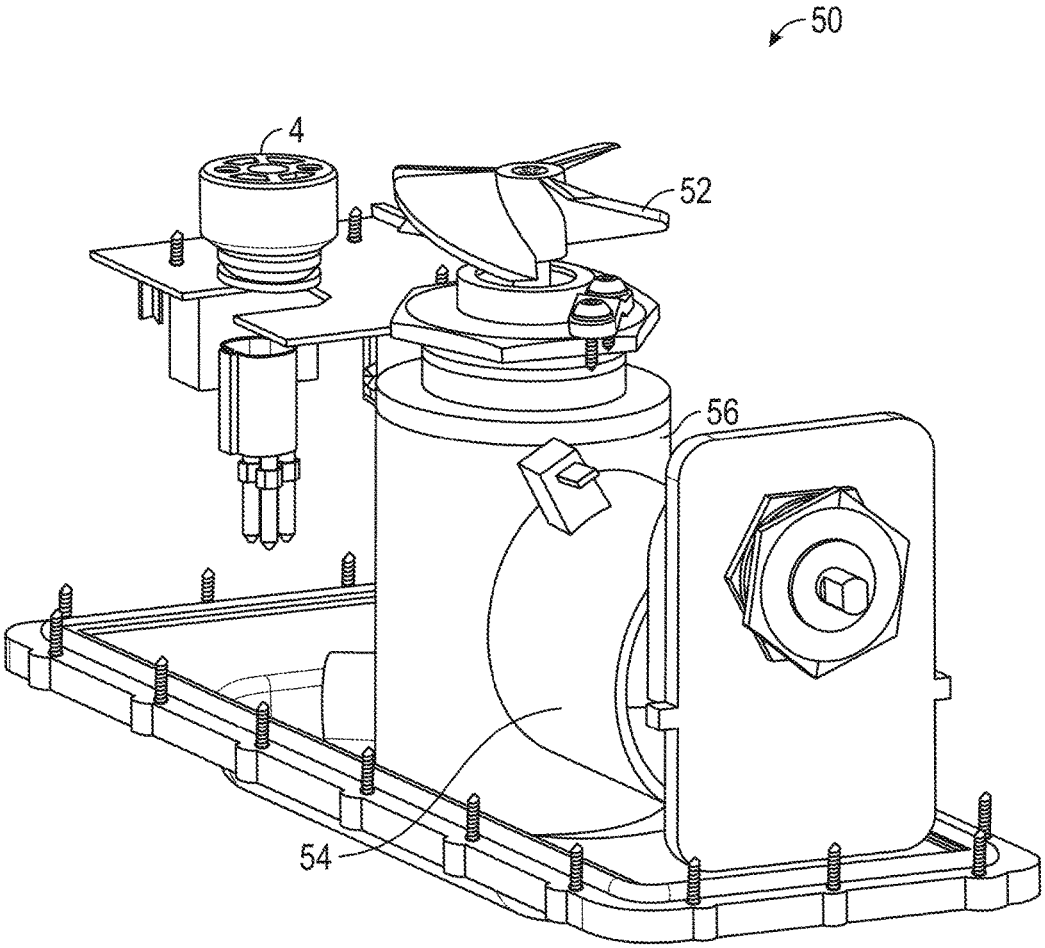
FIG. 6 illustrates a pump unit in accordance with at least one example of the present disclosure.

As shown in FIG. 6, the pool cleaning robot 10 can include a pump unit 50 operably coupled to the one or more inlets 20 and an impeller 52 configured to draw water from the pool through the one or more inlets 20. In an example, a drive motor 54 and/or a pump motor 56, interconnected with the impeller 52 can provide enough suction force to maintain at least one of the bottom wheel (not shown), track 8, or brush 6 in contact with the sidewall or floor of the pool. Further, the pump unit 50, including the drive motor 54 and/or pump motor 56, can be configured to maintain the one or more germicidal light sources 18 within a specified distance of the pool surface.

In an example, the pool cleaning robot 10 can include a balancing system configured to maintain the robot upright, so as to maintain the bottom side 17 of the main housing 2 toward the pool surface. The balancing system can include the propulsion unit or the pump unit 52. An exemplary balancing system and corresponding parts is described in US Patent Pub. No. 2008/0128343, which is incorporated herein by reference in its entirety.

Figure 7:
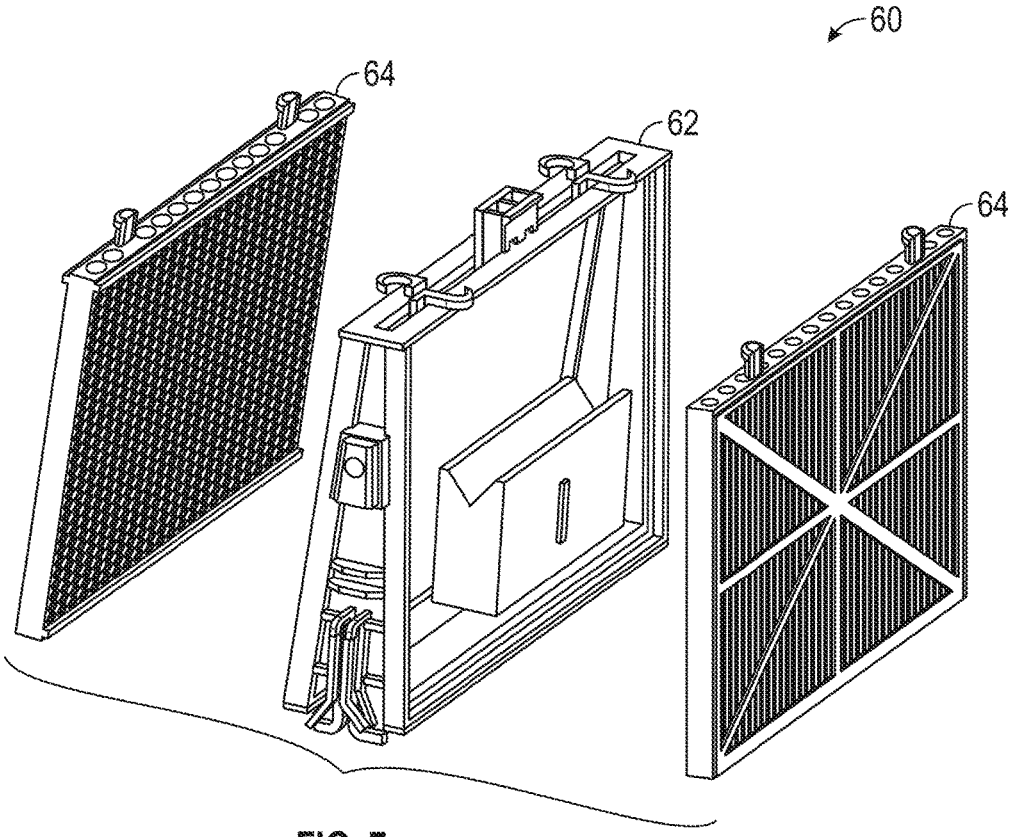
FIG. 7 illustrates a filter unit in accordance with at least one example of the present disclosure.

The water drawn from the pool can be passed through a filter 60, as shown in FIG. 7, to remove at least a portion of the debris in the water. The pool cleaning robot 10 can include one or more filter cartridges 64 housed in a filter frame 62, to permit a user to choose a degree of filtering performed by the robot. The filter unit 60 can include any filter configured to filter debris from pool water, such as the filter described in US Patent Pub. No. 2012/0306931, which is incorporated herein by reference in its entirety. In an example, the pump unit 50 can draw water and debris into the one or more inlets 20 in the bottom side 17 of the main housing 2, filter the debris in the filter unit 60, and expel the filtered water out through the outlet 4 in the top side 5 of the main housing 2.

The one or more germicidal light sources 18 can be configured to provide ultraviolet germicidal irradiation (UVGI) to a pool surface to kill at least a portion of microorganisms present on the pool surface. Particularly, the one or more germicidal light sources 18 can provide sufficient short wavelength light to destroy the nucleic acids in microorganisms. In an example, the one or more germicidal light sources 18 can include a short-wavelength ultraviolet (UV-C) light emitting source. The UV-C light emitting source can include a low pressure lamp, medium pressure lamp, or a high pressure lamp. In an example, the UV-C light emitting source can be removed and replaced for specific purposes. For example, a low pressure lamp can be better in applications of energy efficiency, where the use of a high pressure lamp can be better for use in a first cleaning of pool season. The UV-C light emitting source can be configured to emit light from at least about 60 nanometers (nm), 70 nm, 80 nm, 90 nm, 100 nm, or 110 nm. The UV-C light emitting source can be configured to emit light from less than about 350 nm, 320 nm, 300 nm, 280 nm, or 260 nm.

In an example, the one or more germicidal light sources 18 can be housed in an elongated tube 19 attached to the main housing 2, so as to form an air tight environment. The elongated tube 19 can be configured to provide a transparent or translucent tube wall or to otherwise permit passage of light of one or more desired wavelengths through the elongated tube 19 to a pool surface. For example, the elongated tube 19 can be configured to permit passage of UV-C light through a tube wall of the elongated tube 19. The elongated tube 19 can include UV-C light penetrable glass, UV-C light penetrable quartz, UV light penetrable quartz glass, or UV-C light penetrable plastic, among others. In an example, the elongated tub 19 can be fused quartz. In an example, the elongated tube 19 can be configured to absorb a mercury emission line. Benefits of such an example can provide added safety for a user. In addition to or instead of the elongated tube 19, an example can include a transparent or translucent material that covers the one or more germicidal light sources, such as a substantially flat plate or insert. However, the one or more germicidal light sources 18 are not limited to elongated tubes 19, as shown in FIG. 3. For example, the one or more germicidal light sources 18 can include a light emitting diode (LED) germicidal light source, such that a flat or non-cylindrical light source can be employed. That is, the present subject matter contemplates any form, shape, or size of germicidal light source capable of being mounted to the pool cleaning robot.

The one or more germicidal light sources 18 can be configured to be spaced a distance from the pool surface such that an area of pool surface exposed to the light can be optimized while still maintaining the germicidal properties of the light source. For example, the one or more germicidal light sources 18 can be at least about 0.1 inches (in), about 0.2 in, about 0.3 in, about 0.4 in, about 0.5 in, about 0.6 in, or about 0.7 in from the pool surface. Further, the one or more germicidal light sources 18 can be less than about 2.0 in, about 1.8 in, about 1.6 in, about 1.5 in, about 1.4 in, about 1.3 in, about 1.1 in, or about 0.8 in from the pool surface. In an example, the bottom side 17 of the main housing 2 of the pool cleaning robot 10 can include at least one reflector 21 such as a mirror or reflecting surface, configured to reflect the germicidal light from the one or more germicidal light sources 18 toward the surface of the pool.

The power unit of the pool cleaning robot 10 can provide power to one or more functions of the robot including the one or more germicidal light sources 18, the propulsion unit 70, the pump unit 50, or any other motor on board the robot. In an example, the power unit includes at least one battery. The battery can be rechargeable, for example by removing and recharging the battery, or can be fixed within the pool cleaning robot 10 and recharged by plugging the pool cleaning robot 10 into a power outlet. In an example, the pool cleaning robot 10 can include a power cord or a power cord receptacle configured to connect to an external source of power. The power cord can be fixed to the main housing 2 or can be removable. If the power cord is fixed to the main housing 2, the power cord can include a 360 degree swivel configured to reduce tangles in the cord that can result from the pool cleaning robot 10 moving around the pool. In an example, the power unit can include one or more solar cells on the pool cleaning robot 10 or the power cord, so as to provide energy to power the pool cleaning robot 10 or its associated equipment, as described herein. In various examples, any combination of various power unit 70 configurations described herein can be used to power to one or more functions.

In an example, the pool cleaning robot 10 can include one or more germicidal light source safety features. For example, a temperature sensor can be provided that automatically shuts off the one or more germicidal light sources 18 if an upper threshold temperature is measured. The upper threshold temperature can be based on material properties of the elongated tube 19, the bottom side 17 of the main housing 2, or other characteristics. Another example can include a shut off switch configured to shut off the one or more germicidal light sources 18 upon the occurrence of a particular event, such as the pool cleaning robot 10 being turned more than 90 degrees from a flat surface. In an example, the shut off switch can include a contact switch configured to shut at least the one or more germicidal light sources 18 off when the contact switch is not depressed. The contact switch can be configured to depress when the track 8 is in contact with a surface, such as a pool floor or wall. In another example, the switch can include a gyroscopic switch configured to shut at least the one or more germicidal light sources 18 off when the pool cleaning robot 10 is oriented beyond a threshold angle, such as 90 degrees. The benefits of a safety switch include preventing a user from being exposed to harmful UV rays.

Figure 8:
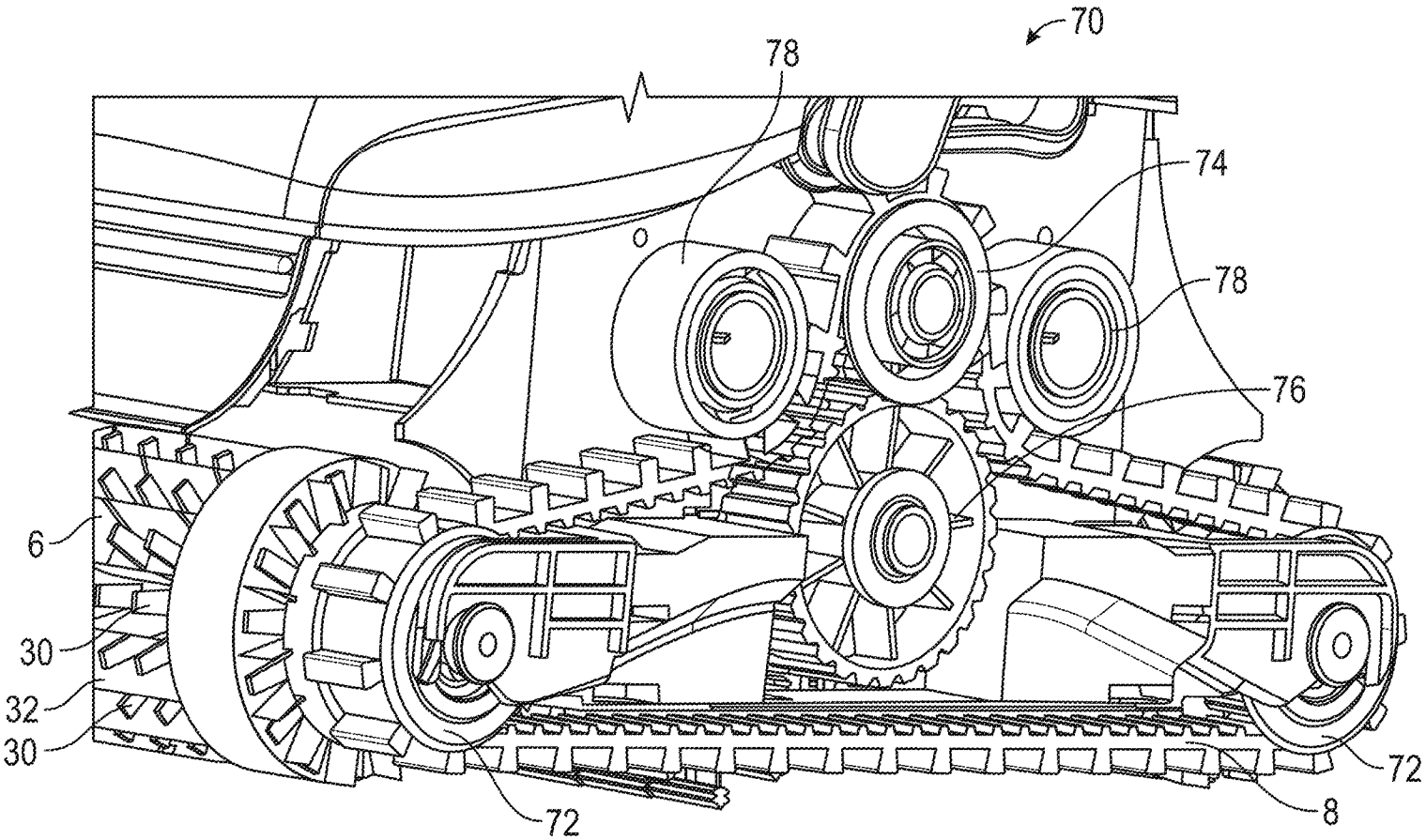
FIG. 8 illustrates a propulsion unit in accordance with at least one example of the present disclosure.

As shown in FIG. 8, the pool cleaning robot 10 can include a propulsion unit 70 configured to provide propulsion to the robot. The propulsion unit 70 can include one or more wheels 72 configured to contact the pool surface to provide motion to the pool cleaning robot 10. Although the pool cleaning robot 10 of FIG. 6 illustrates a track 8 tightened around the two wheels 72, examples are not so limited. In an example, a drive gear 74 can be operably connected to the drive motor 54, as illustrated in FIG. 6. Additional components can include, but are not limited to, a compound gear 76 or one or more tension rollers 78. An exemplary propulsion unit and corresponding parts is described in US Patent Pub. No. 2008/0128343, which is incorporated herein by reference in its entirety.

Figure 9:
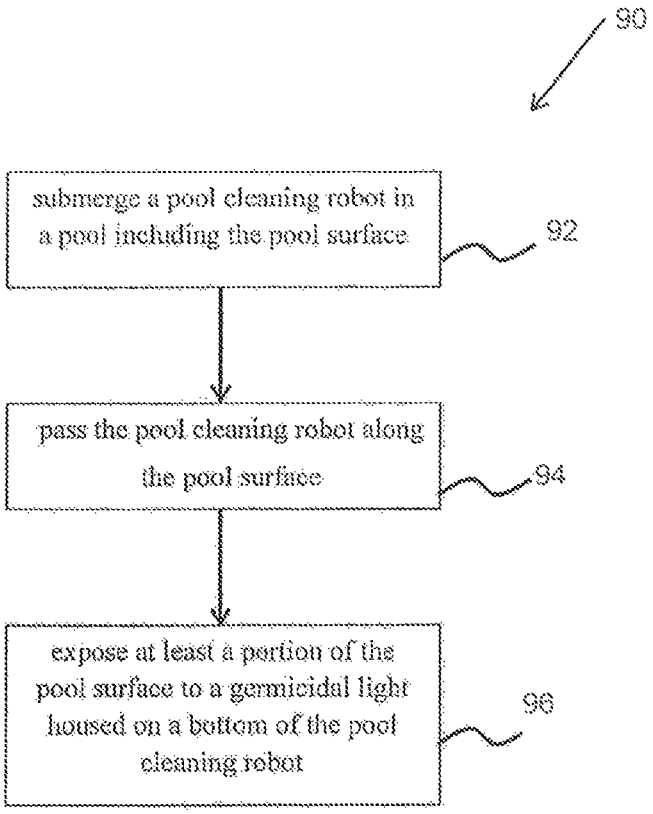
FIG. 9 is a flow chart illustrating a method for cleaning a swimming pool surface with a robotic swimming pool cleaner in accordance with at least one example of the present disclosure.

FIG. 9 is a flowchart illustrating an exemplary method 90 of cleaning a pool surface. At 92, a pool cleaning robot can be submerged in a pool including at least one pool surface. The pool cleaning robot can include the robot illustrated in FIGS. 1-5B and described herein. At 94, the pool cleaning robot can be passed along a pool surface of the at least one pool surface. The pool cleaning robot can pass along the pool surface by way of a wheel or track driving the pool cleaning robot, as described herein.

At 96, a germicidal light of the pool cleaning robot can be exposed to at least a portion of the pool surface. The germicidal light can be powered by an on-board battery or by a power cord, connected to a main housing by a 360 degree swivel, in communication with a power outlet. The germicidal light can include a UV-C light emitting source within a fused quartz tube sealed to the bottom of the pool cleaning robot. The fused quartz tube can permit the germicidal light emitted by the UV-C light emitting source to pass through the fused quartz tube walls to expose the portion of the pool surface to the germicidal light. The light can pass in close proximity to the pool surface, such as within about 0.1 inches to about 1.5 inches of the pool surface. The UV-C light emitting source can be automatically shut off by a gyroscopic switch upon detecting the pool cleaning robot is beyond a threshold angle or orientation, such as beyond about 90 degrees. In another example, the method can include automatically switching the UV-C light emitting source off when a contact switch detects the pool cleaning robot and the pool surface are not in contact.

The surface of the pool can be brushed with at least one rotatable brush rotatably attached to the pool cleaning robot. The brushing of the pool surface can dislodge a portion of debris on the pool surface. Water, including the dislodged debris, can be pumped from the pool through an inlet in the bottom of the pool cleaning robot. The water including the dislodged debris can be pumped through a filter 60, to produce filtered water, which can be provided back to the pool by an outlet 4 in the top of the pool cleaning robot 10. The water can be pumped by a pump unit 50, including an impeller 52, that can provide sufficient suction force to pump the water through the one or more inlets 20 and out the outlet 4 of the pool cleaning robot 10 while providing sufficient suction force for maintaining the bottom of the pool cleaning robot on the pool surface.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including"

and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A pool cleaning robot, comprising:

a main housing configured to be submerged in a pool;

a propulsion unit within the main housing configured to move the pool cleaning robot along a pool surface;

one or more germicidal light sources positioned on a bottom of the main housing such that light generated from the one or more germicidal light sources pass outside of the main housing through the bottom of the main housing, the one or more germicidal light sources configured to disinfect at least a portion of a pool surface by permitting the light generated from the one or more germicidal light sources to pass to the pool surface outside of the main housing; and a power unit configured to power at least the propulsion unit and the one or more germicidal light sources.

2. The pool cleaning robot of claim 1, wherein the one or more germicidal light sources comprise:

a short-wavelength ultraviolet (UV-C) light emitting source; and an elongated tube attached to the main housing and configured to contain the UV-C light emitting source in an air tight environment.

3. The pool cleaning robot of claim 2, wherein the elongated tube includes fused quartz.

4. The pool cleaning robot of claim 1, wherein the one or more germicidal light sources are configured to be positioned less than about 1.5 inches from a pool surface.

5. The pool cleaning robot of claim 1, wherein the one or more germicidal light sources are configured to emit light from about 90 nanometers to about 300 nanometers in wavelength.

6. The pool cleaning robot of claim 1, further comprising one or more brushes rotatable about an axis of rotation and configured to contact a pool surface.

7. The pool cleaning robot of claim 1, further comprising a pump unit, including: one or more inlets in the bottom of the main housing, configured to intake at least water; and an impeller configured to pump water through the inlet.

8. The pool cleaning robot of claim 1, wherein the pump unit is configured to provide enough suction force to maintain the pool cleaning robot in contact with a pool surface.

9. The pool cleaning robot of claim 1, wherein the power unit further comprises a power cord configured to connect to a power outlet, the power cord including a 360 degree swivel configured to reduce tangles in the power cord.

10. The pool cleaning robot of claim 1, wherein the power unit includes one or more batteries on or within the main housing.

11. The pool cleaning robot of claim 1, further comprising a switch to automatically shut off the one or more germicidal light sources.

12. A pool cleaning robot, comprising:

a main housing configured to be submerged in a pool having a bottom side configured to be adjacent to a pool surface;

a propulsion unit within the main housing configured to move the pool cleaning robot along the pool surface;

an elongated transparent fused quartz tube attached to the bottom of the main housing;

a short-wavelength ultraviolet (UV-C) light emitting source, configured to emit a germicidal light to disinfect at least a portion of the pool surface, housed in an air tight environment within the elongated transparent fused quartz tube;

a pump unit, including:

an inlet in the bottom of the main housing, configured to intake water; and a pump motor configured to pump water from the pool through the inlet; and a power unit configured to power the propulsion unit, the short-wavelength ultraviolet (UV-C) light emitting source, and the pump unit.

13. The pool cleaning robot of claim 12, further comprising one or more reflectors on the bottom of the main housing configured to reflect the germicidal light toward a pool surface.

14. The pool cleaning robot of claim 12, wherein the propulsion unit includes one or more wheels configured to drive movement of the pool cleaning robot, the one or more wheels having a contact surface configured to contact the pool surface, and wherein a distance between the contact surface and the UV-C light emitting source is no more than 1.5 inches such that the UV-C light emitting source is within a distance of about 0.1 inches to about 1.5 inches from the pool surface.

* * * * *